US006452619B2

(12) United States Patent
Kushida et al.

(10) Patent No.: US 6,452,619 B2
(45) Date of Patent: Sep. 17, 2002

(54) THERMAL TRANSFER RECORDING APPARATUS AND METHOD FOR THERMAL TRANSFER RECORDING

(75) Inventors: Hiroyuki Kushida, Odawara; Mitsuharu Endo, Susono, both of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 24 days.

(21) Appl. No.: 09/753,506

(22) Filed: Jan. 3, 2001

(30) Foreign Application Priority Data

Jan. 14, 2000 (JP) ..... 2000-006649
Oct. 12, 2000 (JP) ..... 2000-312116

(51) Int. Cl.[7] ..... B41J 33/00; B41J 15/10; B41J 2/325

(52) U.S. Cl. ..... 347/173; 347/217

(58) Field of Search ..... 347/173, 217; 428/195, 913, 207; 156/238; 502/104

(56) References Cited

U.S. PATENT DOCUMENTS 4,978,580 A 12/1990 Tezuka et al.
5,707,715 A * 1/1998 deRochemont et al. ..... 428/209
5,964,976 A 10/1999 Tanaka et al.
6,323,151 B1 * 11/2001 Siedle et al. ..... 502/104

FOREIGN PATENT DOCUMENTS

DE 197 54 476 A 6/1998
EP 427 212 A 5/1991
EP 686 510 A 12/1995
EP 700 791 A 3/1996
EP 765 760 A 4/1997
EP 849 089 A 6/1998
JP 59-188452 10/1984
JP 64-40378 2/1989
JP 8-52942 2/1996
JP 10-16407 1/1998
JP 10-226178 8/1998

OTHER PUBLICATIONS

Official Action in European Application No. 01 100 231.8–1251, dated Jan. 2, 2002 (4 pages).

* cited by examiner

*Primary Examiner*—John Barlow
*Assistant Examiner*—K. Feggins
(74) *Attorney, Agent, or Firm*—Frishauf, Holtz, Goodman & Chick, P.C.

(57) ABSTRACT

Using a thermal transfer recording medium formed with thermal transfer recording material on a surface of a supporting material, of which dynamic shear modulus of elasticity is within a range of $1\times10^3$ Pa to $8\times10^5$ Pa, and loss tangent tan δ is within a range of 0.6 to 2.5 measured in dynamic viscoelasticity measurement in a temperature range of the melting point thereof to 50° C. over the melting point at a frequency of 0.5 Hz, pressurizing the heat generating elements against the thermal transfer recording medium to bring the same into contact therewith with a load of 0.3 to 1.0 N/mm, which is a load per unit length in the main direction of the arrangement of the heat generating elements, transferring the thermal transfer recording material to the printing medium.

28 Claims, 8 Drawing Sheets

THERMAL TRANSFER RECORDING APPARATUS AND METHOD FOR THERMAL TRANSFER RECORDING

CROSS-REFERENCE TO RELATED APPLICATIONS

This application is based upon and claims the benefit of priority from the prior Japanese Patent Applications No. 2000-006649, filed Jan. 14, 2000; and No. 2000-312116, filed Oct. 12, 2000, the entire contents of which are incorporated herein by reference.

BACKGROUND OF THE INVENTION

The present invention relates to a thermal transfer recording apparatus and method for thermal transfer recording for transferring and recording thermal transfer recording material of a thermal transfer recording medium on a printing medium utilizing heat generation of a heat generating element of a line type thermal head.

With regard to a thermal transfer recording apparatus, for example, it is known in Jpn. Pat. Appln. KOKAI Publication No. 59-188452. As shown in FIG. 16, it comprises print units 101, 102, 103 and 104 of yellow, magenta, cyan and black, respectively, which are disposed in this order along a straight conveyance path 106 for a printing medium 105.

The print unit 101 for yellow includes a line type print head 101-1 utilizing a thermal head, a thermal transfer recording mechanism having spools 101-3 for supplying an yellow ribbon as a thermal transfer recording medium 101-2 including yellow ink over a heating face of a heat generating element constituting the line type print head 101-1 and a transfer pressure roller 101-4.

The other print units 102 to 104 have the exactly same structure as the yellow print unit 101 described above except the color to be used for thermal transfer recording medium, i.e., magenta, cyan and black, respectively; and comprise line type print head 102-1, 103-1 and 104-1, respectively, thermal transfer recording mechanism having spools 102-3, 103-3, 104-3, respectively, for supplying the thermal transfer recording medium 102-2, 103-2, 104-2, respectively, over the heating face of the heat generating element constituting the line type print head, respectively, and the transfer pressure roller, respectively.

It is arranged that a printing medium 105 is conveyed from the feed rollers 107 and the yellow print unit 101 toward the black print unit 104 on the conveyance path 106 and among each print 101 to 104, and it passes through between the thermal recording media 101-2 to 104-2 and the transfer pressure rollers 101-4 to 104-4.

When carrying out recording, while conveying the printing medium 105 from the yellow print unit 101 through to the black print unit 104, yellow is transferred first at the yellow print unit 104. When the transferred portion comes to the heating face of each print head 102-1 to 104-1 on each print unit 102 to 104, each color is transferred synchronously overlapping in order. At this time, colors are overlapped and mixed, thus it is made possible to record a desired hue.

As described hereinbefore, in a thermal transfer recording in which three or four print units are provided and each print head prints a specific color, different from a method in which only one print head prints a plurality of colors, as a printing medium 105 is not reciprocally conveyed frequently, it is made possible to carry out a high speed recording.

Also, in Jpn. Pat. Appln. KOKAI Publication No. 10-226178, it is disclosed that a thermal transfer recording medium of which dynamic modulus of elasticity at 70° C. is $1\times10^{6}$ to $1\times10^{10}$ in order to form a recorded image excellent in abrasion resistance and heat resistance using a line type thermal head.

Further, in Jpn. Pat. Appln. KOKAI Publication No. 8-52942, it is disclosed that a thermal transfer recording medium of which loss tangent tan δ measured by viscoelasticity measurement of ink layer at 60° C. to 100° C. is within a range of 0.4 to 2.5 is used in order to make a clear thermal transfer recording on a plan medium to be transferred at a low cost.

Furthermore, in a thermal transfer recording apparatus utilizing a serial type thermal head, for example, a thermal transfer recording medium is pressed to bring the same into contact with a printing medium with a large line pressure of approximately 2.0 N/mm. Line pressure means load per unit length in the direction of the arrangement of the heat generating elements. It is known that even when the smoothness of the surface of the printing medium is low (coarse), unevenness of the surface is made smooth and the adhesiveness of the thermal transfer recording medium is increased. Further, in a thermal transfer recording apparatus utilizing a serial type thermal head, thermal transfer recording medium such as an ink ribbon is narrow in width and it is made possible to be compact in size and to be stored in a cassette. As a result, it provides an advantage that wrinkles are hardly generated on the thermal transfer recording medium even when a relatively large line pressure is given thereto.

Whereas, in a line type thermal head mounted with a line type thermal head, a line type thermal transfer recording medium was prepared utilizing the same technique as that for conventional thermal transfer recording medium, and the thermal transfer recording material in a softened or melted status by a heat from a thermal head was peeled off from the thermal transfer recording medium before it cooled down to a room temperature to a printing medium under conveyance, of which smoothness of the surface is low (coarse). As a result the following problems were found, i.e., ink was not transferred well onto the unevenness on the surface of the printing medium, and it was unstable; the edge of the recorded image was not sharp but zigzag resulting in a low quality of the recorded image. However, when a recorded image is required a dimensional accuracy, or when a high resolution recorded image is required, for example, bar code or OCR (Optical Character Recognition) etc which carry out reading process of a recorded image information with an optical means after recording, quality of the edge becomes essential. Still further, when a color recording in which a plurality of thermal transfer recording materials of different colors are transferred overlapping in order, due to not only smoothness of the surface of a printing medium but also the thermal transfer recording material of the thermal transfer recording medium previously transferred thereto, the edge of the recorded image may become zigzag. A problem is that desired recorded image can not be obtained.

Furthermore, another problem is: when a large line pressure is given to a line type thermal head same as a serial type thermal head used in a thermal transfer recording apparatus in order to increase the adhesiveness between the thermal transfer recording material of a thermal transfer recording medium and a printing medium, as the width of the thermal transfer recording medium is wider than that of the serial type, it is difficult to apply an even line pressure over the full width of the thermal transfer recording medium. As a result, wrinkles are easily generated resulting in a low quality of the recorded image.

As described hereinbefore, such problems exist that, when a thermal transfer recording material in a softened or melted status by a heat from the heat generating elements on a line type thermal head is peeled off from the supporting material of the thermal transfer recording medium and transferred to a printing medium under conveyance before it cools down to a room temperature, if the line pressure of the head is increased, wrinkles are generated; while if the line pressure is reduced to prevent the wrinkles from being generated, it causes an unstable transfer and a high quality recorded image can not be obtained.

BRIEF SUMMERY OF THE INVENTION

An object of the present invention is to provided a thermal transfer printing apparatus utilizing a line type thermal head provided with a plurality of heat generating elements disposed thereon, which enables to obtain a high quality recorded image with sharp edges.

Another object of the present invention is to provided a method for thermal transfer printing utilizing a line type thermal head provided with a plurality of heat generating elements disposed thereon, which enables to obtain a high quality recorded image with sharp edges.

In accordance with the present invention, a thermal transfer recording apparatus comprises a line type thermal head provided with a plurality of heat generating elements disposed thereon; a thermal transfer recording medium formed with thermal transfer recording material over a supporting material, of which dynamic shear modulus of elasticity is within a range of $1\times10^3$ Pa to $8\times10^5$ Pa, and loss tangent tan δ is within a range of 0.6 to 2.5 measured in dynamic viscoelasticity measurement in a temperature range of the melting point thereof to 50° C. over the same at a frequency of 0.5 Hz; first conveyance means for conveying a printing medium; second conveyance means for conveying each heat transfer recording medium; pressure contact means for pressurizing the heat generating elements against the thermal transfer recording medium to bring the same into contact therewith with a load of 0.3 to 1.0 N/mm, which is load per unit length in the direction of the arrangement of the heat generating elements; and transfer means for transferring the thermal transfer recording medium to the printing medium by heating each heat generating element of the line type thermal head when carrying out a recording and by peeling off the same in a softened or melted status from the supporting material thereof.

In accordance with the present invention, a method for thermal transfer recording to transfer a thermal transfer recording material from a thermal transfer recording medium to a printing medium to make a printing by heating each heat generating element of a line type thermal head provided with a plurality of heat generating elements disposed thereon, comprises the steps of utilizing a thermal transfer recording material of which dynamic shear modulus of elasticity is within a range of $1\times10^3$ Pa to $8\times10^5$ Pa, and loss tangent tan b is within a range of 0.6 to 2.5 measured in dynamic viscoelasticity measurement in a temperature range of the melting point thereof to 50° C. over the same at a frequency of 0.5 Hz; pressurizing heat generating elements on the line type thermal head against the thermal transfer recording medium to bring the same into contact therewith with a load of 0.3 to 1.0 N/mm, which is load per length in the direction of the arrangement of the heat generating elements as well as transferring the thermal transfer recording material to the printing medium by peeling off the same in a softened or melted status from the supporting material thereof.

Further, in accordance with the present invention, it is made possible to provide a thermal transfer recording apparatus which enables to obtain a high quality recorded image with sharp edges stably on a printing medium with coarse surface under conveyance by utilizing a line type thermal head of which line pressure does not generate wrinkles on a thermal transfer recording medium, and by utilizing a thermal transfer recording material of the thermal transfer recording medium having a specific dynamic shear modulus of elasticity and loss tangent tan δ characteristic in order to peel off the thermal transfer recording material in a softened or melted status from the supporting material of the thermal transfer recording medium and to transfer to a printing medium.

Further, in accordance with the present invention, it is made possible to provide a method for thermal transfer recording, which enables to obtain a high quality recorded image with sharp edges stably on a printing medium with coarse surface under conveyance by utilizing a line type thermal head of which line pressure does not generate wrinkles on a thermal transfer recording medium, and by utilizing a thermal transfer recording material of the thermal transfer recording medium having a specific dynamic shear modulus of elasticity and loss tangent tan δ characteristic in order to peel off the thermal transfer recording material in a softened or melted status from the supporting material of the thermal transfer recording medium and to transfer to a printing medium.

Still further, in accordance with the present invention, it is made possible to provide a method for thermal transfer recording, which enables to obtain a high quality recorded image with sharp edges without being influenced by the smoothness of the surface of a printing medium and/or the thermal transfer recording material previously transferred on the thermal transfer recording medium even when carrying out a color recording by transferring a plurality of thermal transfer recording material of different colors overlapping in order.

As described hereinbefore, it is very effective for recording an image which is required dimensional accuracy of the record or for recording a high resolution image.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Now, referring to the figures, a description will be made as to an embodiment of the present invention.

Figure 1:
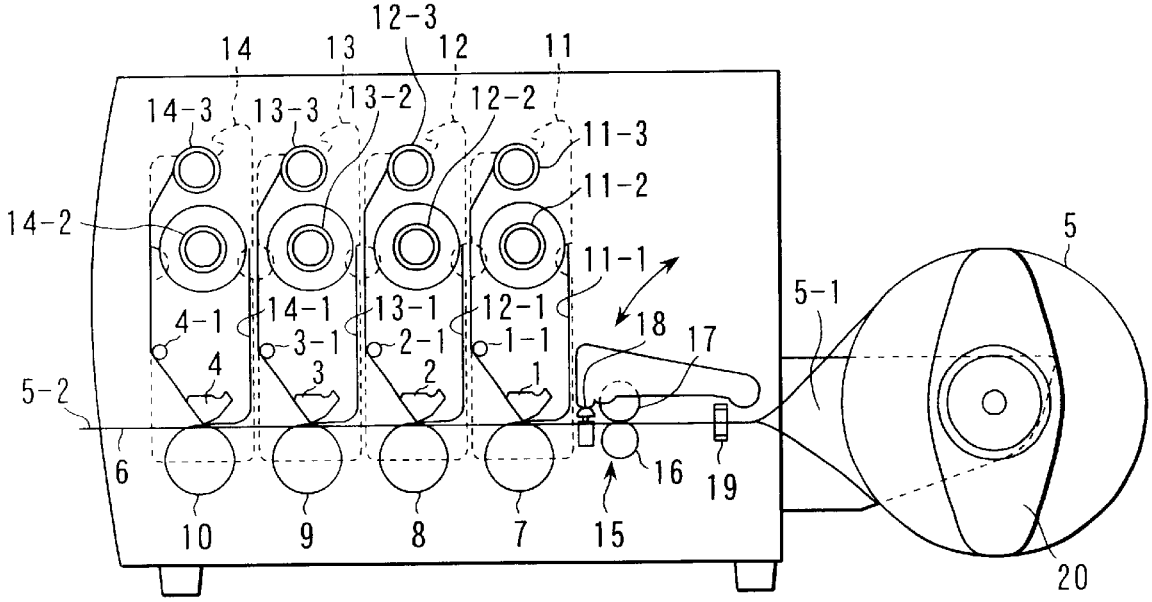
FIG. 1 is a schematic illustration of an essential part of a thermal transfer recording apparatus according to an embodiment of the present invention.

FIG. 1 is a schematic illustration of an essential part of a thermal transfer recording apparatus according to an embodiment of the present invention, which enables to transfer overlapping four colors, i.e., black (K), magenta (M), cyan (C), yellow (Y).

In the figures, reference numeral 1 denotes a line type thermal head for black (hereinafter, referred to as thermal head for K), 2 denotes a line type thermal head for magenta (hereinafter, referred to as thermal head for M), 3 denotes a line type thermal head for cyan (hereinafter, referred to as thermal head for C), 4 denotes a line type thermal head for yellow (hereinafter, referred to as thermal head for Y). Each thermal head 1–4 is, as shown in FIG. 3, an edge type thermal head in which a plurality of heat generating elements 36 are disposed into one line on the edge of a rectangular parallelepiped of 100 mm in longitudinal direction. The resolution of each disposed heat generating element 36 is predetermined 12 dot/mm.

The each thermal head 1–4 is disposed in order over a conveyance path 6 of a printing medium 5 in the direction of conveying direction of the printing medium 5, and parallel to each other. Further, each thermal head 1 to 4 is disposed at intervals of 100 mm.

Now, herein, number of the disposed line type thermal heads is predetermined to 4. However, the number thereof may be 1, 2, 3 or 5 or more.

Disposed facing to each thermal head 1–4 are a platen 7 for black (K), a platen 8 for magenta (M), a platen 9 for cyan (C), a platen 10 for yellow (Y). Further, a thermal transfer recording medium magazine 11 for black (K), a thermal transfer recording medium magazine 12 for magenta (M), a thermal transfer recording medium magazine 13 for cyan (C), a thermal transfer recording medium magazine 14 for yellow (Y) are detachably set respectively.

Disposed within the thermal transfer recording medium magazine 11 for black, are a feed roller 11-2 on which a thermal transfer recording medium for K 11-1 is wound, and a winding roller 11-3 for winding used thermal transfer recording medium for K 11-1; and disposed within the thermal transfer recording medium magazine 12 for magenta, are a feed roller 12-2 on which a thermal transfer recording medium for M 12-1 is wound, and a winding roller 12-3 for winding used thermal transfer recording medium for M 12-1; and disposed within the thermal transfer recording medium magazine 13 for cyan, are a feed roller 13-2 on which a thermal transfer recording medium for C 13-1 is wound, and a winding roller 13-3 for winding used thermal transfer recording medium for C 13-1; and disposed within the thermal transfer recording medium magazine 14 for yellow, are a feed roller 14-2 on which a thermal transfer recording medium for Y 14-1 is wound, and a winding roller 14-3 for winding used thermal transfer recording medium for Y 14-1. Further, disposed between the thermal head 1 and the winding roller 11-3, between the thermal head 2 and the winding roller 12-3, between the thermal head 3 and the winding roller 13-3, between the thermal head 4 and the winding roller 14-3 are peeling guide rollers 1—1, 2-1, 3-1 and 4-1 for guiding conveyance of used thermal transfer recording medium, respectively.

The thermal transfer recording medium for K 11-1, the thermal transfer recording medium for M 12-1, the thermal transfer recording medium for C 13-1, the thermal transfer recording medium for Y 14-1 respectively are set within each thermal transfer recording medium magazine 11 to 14, and each thermal transfer recording medium magazine 11 to 14 is adapted so that the thermal transfer recording medium 11-1 to 14-1 are fed to each thermal head 1 to 4 respectively. Each thermal head 1 to 4 is adapted so as to apply a load of, for example, 0.4 N/mm to the thermal transfer recording medium 11-1 to 14-1 toward each platen 7 to 10 in the direction of the arrangement of the heat generating element 36. Line pressure means load per unit length in the direction of the arrangement of the heat generating element 36.

Disposed at the recording medium feed side of the thermal head for K 1, are a recording medium conveyance roller 16 as a first conveying means 151 for controlling conveyance speed of the printing medium 5 and a auxiliary roller 17 disposed while making a pair with the recording medium conveyance roller 16. Disposed over a conveyance path 6 between the recording medium conveyance roller 16 and the thermal head for K 1 is a sensor block 18 including a gap sensor for detecting gaps between the labels on the printing medium 5 and a marker sensor for detecting a mark printed on the printing medium 5.

Disposed adjacent to a recording medium feed inlet 5-1 of the conveyance path 6, where is further closer to the recording medium feed side of the recording medium conveyance roller 16 is a recording medium end sensor 19 including an optical transmission sensor for detecting the end of the printing medium 5.

At the outside of the recording medium feed inlet 5-1 of the conveyance path 6, a printing medium holder 20 is fixed. Around the printing medium holder 20, the long printing medium 5 is wound. And at the opposite side of the recording medium feed inlet 5-1 of the conveyance path 6, a recording medium outlet 5-2 is formed for discharging a printed printing medium 5. As so structured, the printing medium 5 is conveyed on the conveyance path 6 at a speed of, for example, 150 mm/sec.

Therefore, between each thermal head 1 to 4 and each platen 7 to 10, by conveying the thermal transfer recording medium 11-1 to 14-1 from each thermal transfer recording medium magazine 11 to 14 and the printing medium 5 from the printing medium holder 20 at a substantially same speed, it is possible to print a desired recording image of black, magenta, cyan and yellow in order on the recording medium.

Figure 2:
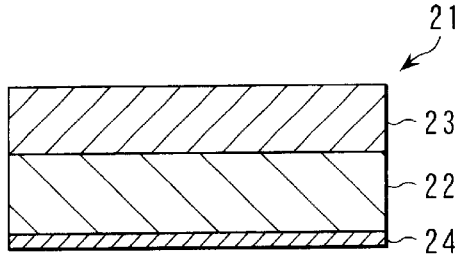
FIG. 2 is a sectional view showing a structure of a thermal transfer recording medium used for a thermal transfer recording apparatus according to an embodiment of the same.

FIG. 2 is a sectional view showing a structure of a thermal transfer recording medium 21 (11-1 to 14-1). The thermal transfer recording medium 21 comprises a supporting material 22 made of a base film layer, a thermal transfer recording material 23 made of an ink layer formed on the supporting material 22 and a back coat layer 24 formed on the bottom face of the supporting material 22 (opposite side of the face formed with the thermal transfer recording material 23 thereon).

The supporting material 22 is made of, for example, polyethylene terephthalate, cellophane, polycarbonate or polyimide. Thickness of the supporting material 22 is predetermined to approximately 1 to 15 $\mu$m; from the view point of mechanical strength and transfer sensitivity etc, a range of 1 to 6 $\mu$m is desirable The thermal transfer recording material 23 is made from, as the main components, coloring agent, resin, and wax. As coloring agents, for cyan, pigments such as copper phthalocyanine blue, Victoria blue lake and fast sky blue, and/or 1 or 2 kinds or more of dyes such as Victoria blue are used. For magenta, pigments such as rhodamine lake B, rhodamine lake T, rhodamine lake Y, permanent red 4R, brilliant fast scarlet, brilliant carmine BS, permanent red F5R, and/or 1 or 2 kinds or more of dyes such as rhodamine are used. For yellow, pigments such benzin yellow G, benzin yellow GR, Hansa yellow G, permanent yellow NCG, and/or 1 or 2 kinds or more of dyes such as auramine are used.

As resins, one or a mix of petroleum resin, polyethylene, ethylene.vinyl acetate copolymer, polyester resin, polyamide resin, acrylic resin, polystyrene is used. As wax, one or a mix of Japan wax, beeswax, carnauba wax, microcrystaline wax, paraffin wax, rise wax, polyethylene wax, polypropylene wax, oxidized wax is used.

The melting of the thermal transfer recording material 23 is 65° C. to 120° C.. From the view point of softening or melting the same using a small applied energy, it is preferable that the melting point thereof is 65° C. to 100° C. The melting point is measured with a differential scanning calorimetry, and its center value of endothermic peak is used. A high molecular resin shows a supper cooling phenomenon, i.e., melted or softened thermal transfer recording material 23 does not become hard soon but become hard slowly even when the temperature decreases quickly.

The back coat layer 24 is formed by applying a coating agent for back coating layer on the bottom face of the supporting material 22 and drying the same. A conventionally used material or equivalent may be used for the back coat layer 24. The object of the same is to provide the thermal head a well-sliding; and to prevent the same from sticking.

Figure 3A:
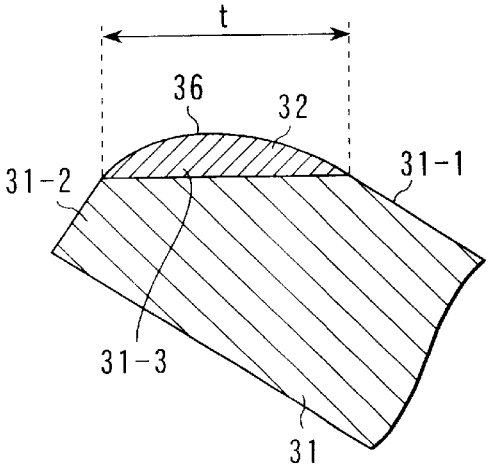
FIG. 3A is a sectional view of the front edge of a line type thermal head according to an embodiment of the same.
Figure 3B:
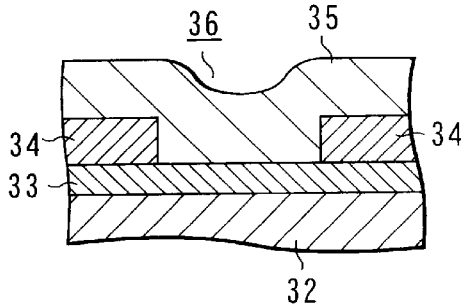
FIG. 3B is a sectional view showing essential structure of a heat generating element formed on a portion of the front edge of a line type thermal head according to an embodiment of the same.

FIG. 3A is a sectional view showing an essential structure of the front edge on each thermal head 1 to 4, FIG. 3B is a sectional view showing an essential structure of the heat generating element 36 formed on a portion of the front thereof. The front portion of the head is made of a material such as alumina and is formed with a flat base 31 including main face 31-1, end face 31-2 and slope face 31-3 therebetween. The width t of the slope face 31-3 is predetermined within a range of 0.2 to 1.0 mm.

The slope face 31-3 is covered with a glass glaze layer 32 of 5 to 50 $\mu$m thickness, and at adjacent to the top of the glass glaze layer 32, the heat generating element 36 is constituted with a heating resistance layer 33 made of Ta—$SiO_2$ etc, which is formed by a vacuum thin film forming process represented by, for example, sputtering method or vacuum evaporation method; an electrode layer 34 made of Al etc and a cover layer 35 made of $Si_3N_4$ or SiC. The circuit of the drive IC etc for controlling power supply to the heat generating element 36 is, for example, packaged on the main face 31-1 and the output terminal thereof is connected with the electrode layer 34.

In the constitution as described as above, it is made possible to convey the printing medium 5 linearly while allowing it to keep contact with the heat generating element 36 (cover layer 35) of the thermal head 1 to 4. Also, it is made possible to reduce the distance wherein the thermal transfer recording medium 11-1 to 14-1 and the printing medium 5 are separated (hereinafter, referred to as peeling distance) after selectively heating the thermal transfer recording medium 11-1 to 14-1. Further, it is made possible to reduce the time wherein the thermal transfer recording medium 11-1 to 14-1 and the printing medium 5 are separated (hereinafter, referred to as peeling time) by increasing the conveyance speed of the printing medium 5.

The thermal transfer recording medium 11-1 to 14-1 are separated from the printing medium 5 during the temperature is still relatively high. At the same time, the thermal transfer recording material 23 of the thermal transfer recording medium 11-1 to 14-1 is still in a softened or melted status.

These constitutions are the advantages peculiar to the line type thermal head which has a structure as described above.

For example, assuming that the peeling distance, i.e., the thermal transfer recording medium 11-1 to 14-1 and the printing medium 5 are separated is 0.2 mm after selectively heating the thermal transfer recording medium 11-1 to 14-1; the conveyance speed of the printing medium 5 is 50 mm/sec; the peeling time will be 4 msec.

To describe additionally, as to each thermal head 1 to 4, an edge type thermal head which has a constitution as shown in FIG. 3 have been described hereinbefore. However, flat type thermal head, which is provided with the heat generating element 36 formed at the edge portion of the main face on the flat base, may be used. When such a flat type thermal head is used, if the conveyance speed of the printing medium 5 is faster than a predetermined speed, substantial peeling time can be reduced. Accordingly, it will not fail to achieve the advantages of the present invention; the same effects as an edge type thermal head will be obtained.

Figure 4:
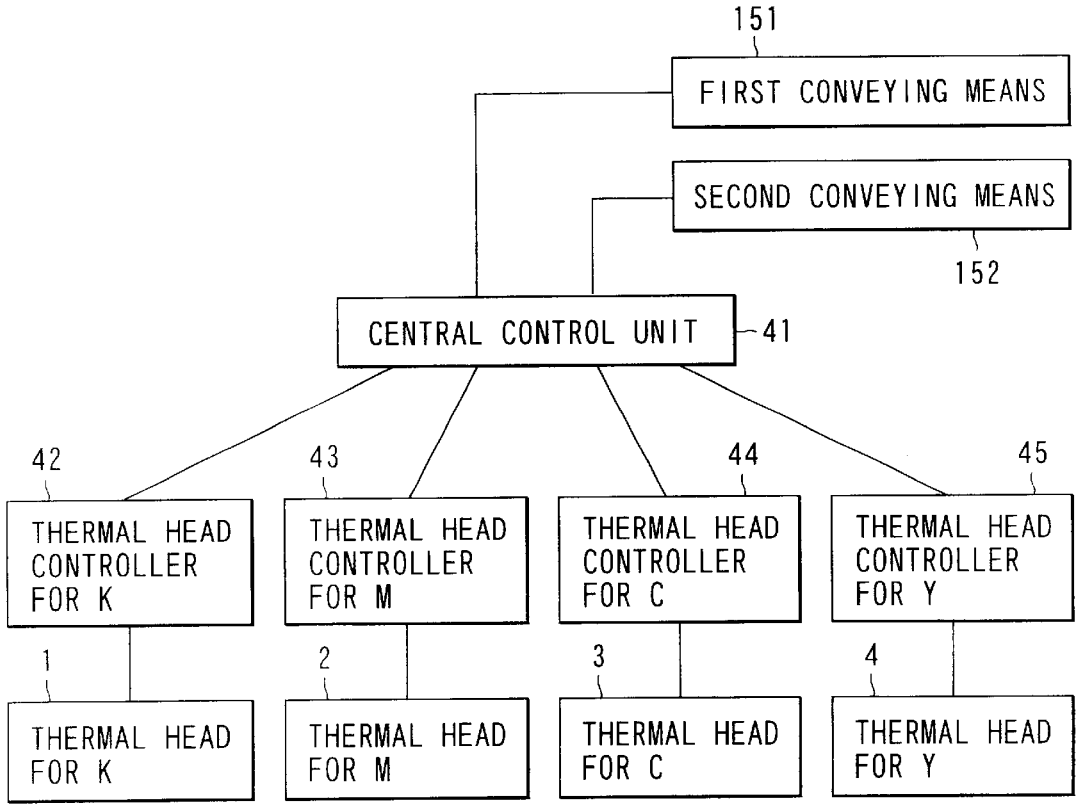
FIG. 4 is a block diagram showing an essential circuit constitution for controlling a line type thermal head according to an embodiment of the same.

FIG. 4 is a block diagram showing an essential circuit constitution for controlling each thermal head 1 to 4.

Reference numeral 41 denotes a central control unit constituting the control main unit including CPU, ROM, RAM, etc by the control signals from the central control unit 41, the thermal head controller for K 42 for controlling the thermal head for K 1, the thermal head controller for M 43 for controlling the thermal head for M 2, the thermal head controller for C 44 for controlling the thermal head for C 3, the thermal head controller 45 for controlling thermal head for Y 4 as well as a first conveying means 151 and a second conveying means 152 are controlled respectively. The second conveying means 152 is a conveying means such as, for example, a motor for conveying the thermal transfer recording medium 11-1 to 14-1.

Each thermal head control 42 to 45 is adapted to control the duty ratio of the drive pulse provided to each thermal head 1 to 4, or the voltage of the drive power with control signals from the central control unit 41.

In an embodiment of the present invention constituted as described above, in a situation immediately after turning on the power supply but recording operation is not started yet, each thermal head 1 to 4 is stayed away from each platen 7 to 10, and the thermal transfer recording medium 11-1 to 14-1 for each color is held still under a predetermined tension.

In this situation, when the printing medium 5 is conveyed from the printing medium holder 20 and it comes closer to an image recording timing of each thermal head 1 to 4, each thermal head 1 to 4 lowers, and each thermal head 1 to 4, each thermal transfer recording medium 11-1 to 14-1, the printing medium 5 and each platen 7 to 10 come in contact forcibly with each other. At a substantially same time, each thermal transfer recording medium 11-1 to 14-1 is conveyed at a substantially same speed as the printing medium 5 and the recording operation is ready to start. After that, the heat generating element 36 is heated based on a recording data and the recording is carried out on the printing medium 5.

For example, the drive circuit for the thermal head for K 1 is driven by the thermal head controller for K 42 a recording data corresponding to the black, each heat generating element 36 for the thermal head for K 1 is selectively heated based on the recording data and the thermal transfer recording material on the thermal transfer recording medium 11-1 at the position of the heated heat generating element 36 is melted and transferred to the printing medium 5. This operation is the same for the thermal head for M 2, thermal head for C 3 and thermal head for Y 4, respectively.

It is possible to heat each heat generating element 36 on each thermal head 1 to 4 simultaneously. If the conveyance speed of the printing medium 5 is 50 mm/sec, each thermal transfer recording medium 11-1 to 14-1 and the printing medium 5 are conveyed by 0.025 mm every 0.5 msec. between the selectively heated thermal transfer recording medium 11-1 to 14-1 and the printing medium 5 which were made contact with each other, the peeling and transferring are made at a position 0.2 mm away from the heating position by each thermal head 1 to 4. Now, distance of each thermal head 1 to 4 is 100 mm; accordingly, color recording is made by overlapping transferring in a short period of time. The heat generating element 36 is heated selectively, for example, at a pulse frequency of 0.5 msec, ON-time of 0.25 msec and with energy of 0.15 mJ/dot.

Next, a description will be made as to the dynamic viscoelasticity of the thermal transfer recording material 23 for the thermal transfer recording medium 21 (11-1 to 14-1).

In measurement of dynamic viscoelasticity of the thermal transfer recording material 23 for the thermal transfer recording medium 21 (11-1 to 14-1), when a sine stress is applied to the thermal transfer recording material 23, the phase of sine strain is delayed by δ depending on its viscosity characteristic. A sine stress means applied stress varied like a sine wave. That is to say, when a torsional vibration is given at a frequency ν, the strain is represented using angular frequency $\omega=2\pi\nu$, $$\gamma(t)=\gamma_0\cos\omega t$$

While, stress is;

$$\sigma(t) = \sigma_0\cos(\omega t + \delta)$$

$$= \sigma_1\cos\omega t - \sigma_2\sin\omega t$$

wherein, $$\sigma_1=\sigma_0\cos\delta,\ \sigma_2=\sigma_0\sin\delta$$

Now, the following function can be defined.

$$G'(\omega) = \frac{\sigma_1(\omega)}{\gamma_0},\ G''(\omega) = \frac{\sigma_2(\omega)}{\gamma_0},\ \tan\delta = \frac{G''(\omega)}{G'(\omega)}$$

where, G' denotes dynamic shear modulus of elasticity, G" denotes loss modulus of elasticity, tan δ denotes loss tangent. These are all the functions for angular frequency.

The inventors of the present invention carried out the measurement of the dynamic shear modulus of elasticity and the loss tangent tan δ using a wide range dynamic viscoelasticity measuring apparatus "Rheolograph GSA" (a parallel plates shear modulus of elasticity measuring apparatus) made by Toyo Seiki Seisaku-Syo Ltd. The measuring apparatus measures dynamic shear modulus of elasticity and loss tangent tan δ by clipping a test sample of a thermal transfer recording material set on the test table with a measuring element from the top, and by giving a sine shearing strain (shearing distortion) to the thermal transfer recording material and thus, by obtaining the response thereof. The following are the test conditions.

| | |
|---|---|
| Size of the test sample: | 0.5 mm in thickness, φ8 mm |
| Frequency: | 0.5 Hz |
| Shearing angle: | ±0.5° |
| Temperature raise: | From a room temperature |

-continued

| |
|---|
| (approximately 15° C. to 30° C.) to 2° C./minute |

Next, a description will be made as to the peeling status of the thermal transfer recording material 23 on the thermal transfer recording medium 21.

In thermal transfer process, if a total of a force necessary to peel off the softened or melted thermal transfer recording material 23 from the supporting material 22 (first force) and a force necessary to break off an area (dot) on the softened or melted thermal transfer recording material 23 to be transferred from an area (dot) on the thermal transfer recording material 23 not be transferred on the supporting material 22 (second forth) is smaller than an adhesive force between the softened or melted thermal transfer recording material 23 and the surface of the printing medium 5 (third force), or the adhesive force between the softened or melted thermal transfer recording material 23 and the thermal transfer recording material 23 which has been already transferred to the printing medium 5 (third force), the transfer is made.

Figure 5:
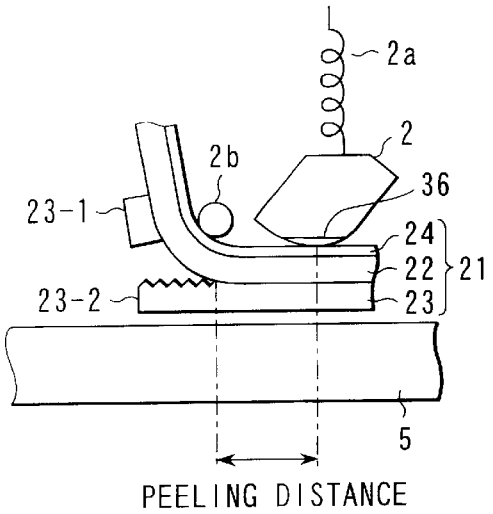
FIG. 5 is an enlarged detail illustrating peeling situation of a thermal transfer recording material used for a thermal transfer recording apparatus according to an embodiment of the same.
Figure 6:
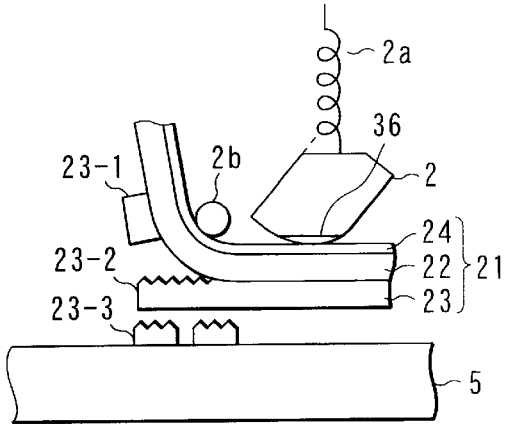
FIG. 6 is an enlarged detail illustrating peeling situation of a thermal transfer recording material used for a thermal transfer recording apparatus according to an embodiment of the same.

FIG. 5 and FIG. 6 are the figures for illustrating peering status of the thermal transfer recording material 23 on the thermal transfer recording medium 21. FIG. 5 shows a situation where the thermal transfer recording material 23 is transferred onto the printing medium 5; FIG. 6 shows a situation where a second color (cyan) is transferred after a first color (magenta) has been transferred on the printing medium 5.

As described hereinbefore, if a total of a force necessary to peel off the softened or melted thermal transfer recording material 23 from the supporting material 22 (first force) and a force necessary to break off an area (dot) 23-2 on the softened or melted thermal transfer recording material 23 to be transferred from an area (dot) 23-1 on the thermal transfer recording material 23 not be transferred (second force) is smaller than an adhesive force between the softened or melted thermal transfer recording material 23 and the surface of the printing medium 5 (third force), or the adhesive force between the softened or melted thermal transfer recording material 23 which has been already transferred to the printing medium 5 (third force), the transfer is made. In a transfer process described above, the thermal transfer recording material 23 may be understood as viscoelastic material which is subject to a shearing force. The heat generating element 36 on the thermal head for M 2 is pressed to the thermal transfer recording medium 21 by an agitating force of a spring 2*a*. Also, the heat generating element 36 is peeled off from the thermal transfer recording material 23 at position of a peel-off guide 2*b* which is disposed at a point away by a peeling distance from the thermal head for M 2. Other thermal head 1, 3 and 4 are also constituted in the same manner.

Further, in a transfer process of the thermal transfer recording apparatus, the thermal transfer recording material 23 is instantly heated up to a temperature higher than the melting point of the thermal transfer recording material 23 itself by a heat of the heat generating element on the line type thermal head. The melting point is a characteristic peculiar to each material, the thermal transfer recording material 23 is a softened or melted status within, at least, a temperature range from the melting point to the melting point plus 50° C. Also, it is cleared as a result of various experiments that the characteristic of viscoelasticity of the thermal transfer recording material 23 within a temperature range of the melting point plus 50° C. largely affects the quality of the recorded image.

Then, the inventors directed the attention to the dynamic shear modulus of elasticity and the loss tangent tan δ of the thermal transfer recording material 23 as objective criteria, i.e., viscoelastic characteristic of the thermal transfer recording material 23 within a temperature range from a melting point to the melting point plus 50° C., which affect the quality of the recorded image transferred and recorded on the printing medium 5 being conveyed by peeling off a softened or melted thermal transfer recording material 23 from the supporting material 22 of the thermal transfer recording medium 21, and evaluation thereof was carried out.

First of all, by measuring the shear modulus of elasticity, the characteristic of the thermal transfer recording material 23 as an elastic material is evaluated quantitatively. Then, by measuring the loss tangent tan δ, a balance between the characteristics of elasticity and viscosity is evaluated qualitatively. Accordingly, by measuring the shear modulus of elasticity and the loss tangent tan δ at the same time, the characteristics of elasticity and viscosity is evaluated quantitatively.

Next, a description will be made as to the procedure for evaluation.

Width of the used line type thermal head is 100 mm; line pressure is 0.7 N/mm; and resolution of the heat generating element 36 is 12 dot/mm. The printing medium 5 is paper of Beck smoothness approximately 300 seconds. The thermal transfer recording medium 21 is a magenta thermal transfer recording medium, and the melting point of the thermal transfer material thereof is 80° C. Evaluation was carried out on the following items under the conditions: conveyance speed of the printing medium 5 is 50 mm/sec; and peeling distance is 0.2 mm.

(1) Transfer probability: As to image elements made of 8 dot×8 dot, number of the image elements which are 90% or more and 110% or less of the size of the normal image element is counted. And its percentage against the total number of samples 50 is calculated.

When the percentage thereof is:

More than 90% . . . AA

More than 80% and 90% or less . . . A

More than 70% and 80% or less . . . B

70% or less . . . C (2) Edge sharpness characteristic of recorded image: monochrome and color (overlapped) rectangular images of 80 mm×10 mm are recorded ten times at a specific distance. And sharpness of the edge on the recorded image was examined with an optical microscope to assess the linearly thereof. Herein, sharpness characteristic is defined as the configuration of the edge of the recorded image transferred with a thermal transfer material, that is, whether it is almost straight or zigzag.

The criterion were predetermined as described below. When the configuration of the edge is:

excellent . . . AA almost straight . . . A slightly unclear (zigzag) . . . B remarkably unclear (zigzag) . . . C Evaluation results were as listed in Table 1 below.

TABLE 1

| Dynamic shear |
|---|

| | modulus of elasticity [Pa] | Loss tangent | Transfer probability | Sharpness |
|---|---|---|---|---|
| M material 1 | $2 \times 10^4$ to $1 \times 10^5$ | 1.1 to 1.9 | A | A |
| M material 2 | $3 \times 10^4$ to $2 \times 10^5$ | 1.7 to 2.5 | A | A |
| M material 3 | $3 \times 10^5$ to $8 \times 10^5$ | 0.6 to 1.1 | A | A |
| M material 4 | $1 \times 10^3$ to $8 \times 10^3$ | 1.5 to 2.2 | A | A |
| M material 5 | $1 \times 10^3$ to $3 \times 10^3$ | 1.6 to 3.1 | B | B |
| M material 6 | $8 \times 10^2$ to $2 \times 10^3$ | 1.8 to 2.5 | B | B |
| M material 7 | $7 \times 10^5$ to $1 \times 10^6$ | 0.6 to 0.7 | B | B |
| M material 8 | $5 \times 10^5$ to $8 \times 10^5$ | 0.5 to 0.6 | C | B |
| M material 9 | $5 \times 10^2$ to $1 \times 10^3$ | 2.0 to 6.5 | C | C |

Also, another evaluation was carried out using thermal transfer recording materials other than magenta. As a result, the same result was obtained. The melting point of the thermal transfer recording material of the cyan thermal transfer recording medium and the same of the yellow thermal transfer recording medium is 79° C. and 78° C., respectively.

From the evaluation results described above, it was cleared that: within a temperature range from the melting point to the melting point plus 50° C. of the thermal transfer recording material 23, when the dynamic shear modulus of elasticity of the thermal transfer recording material 23 falls within $1\times10^3$ Pa to $1\times10^5$ Pa, and the value of the loss tangent tan δ falls within 0.6 to 2.5, a high quality recorded image is obtained.

Figure 7:
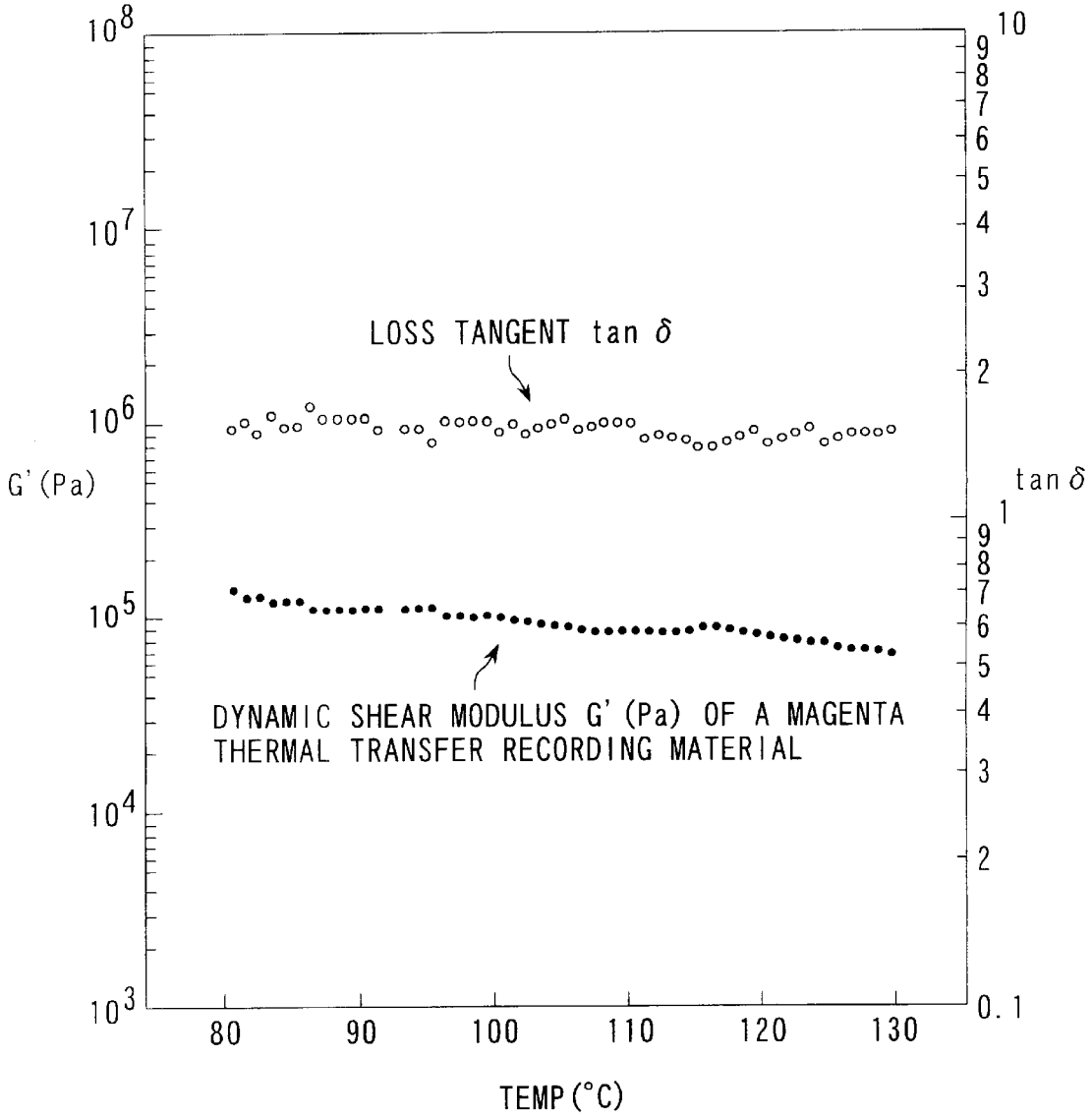
FIG. 7 is a graph representing a characteristic of dynamic shear modulus of elasticity and loss tangent tan δ of a thermal transfer recording material of a magenta thermal transfer recording medium used on a thermal transfer recording apparatus according to an embodiment of the same.
Figure 8:
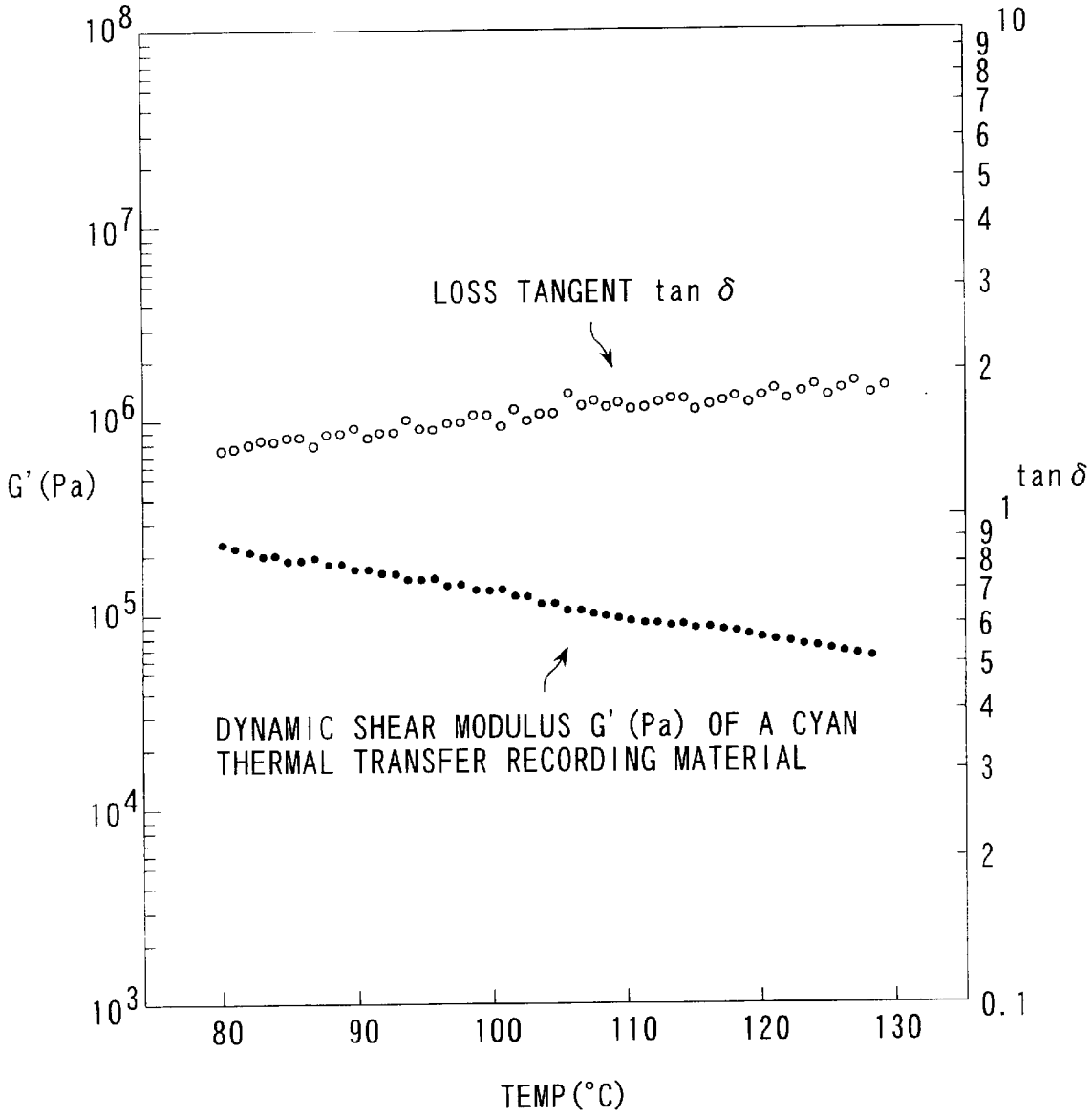
FIG. 8 is a graph representing a characteristic of dynamic shear modulus of elasticity and loss tangent tan δ of a thermal transfer recording material of a cyan thermal transfer recording medium used on a thermal transfer recording apparatus according to an embodiment of the same.
Figure 9:
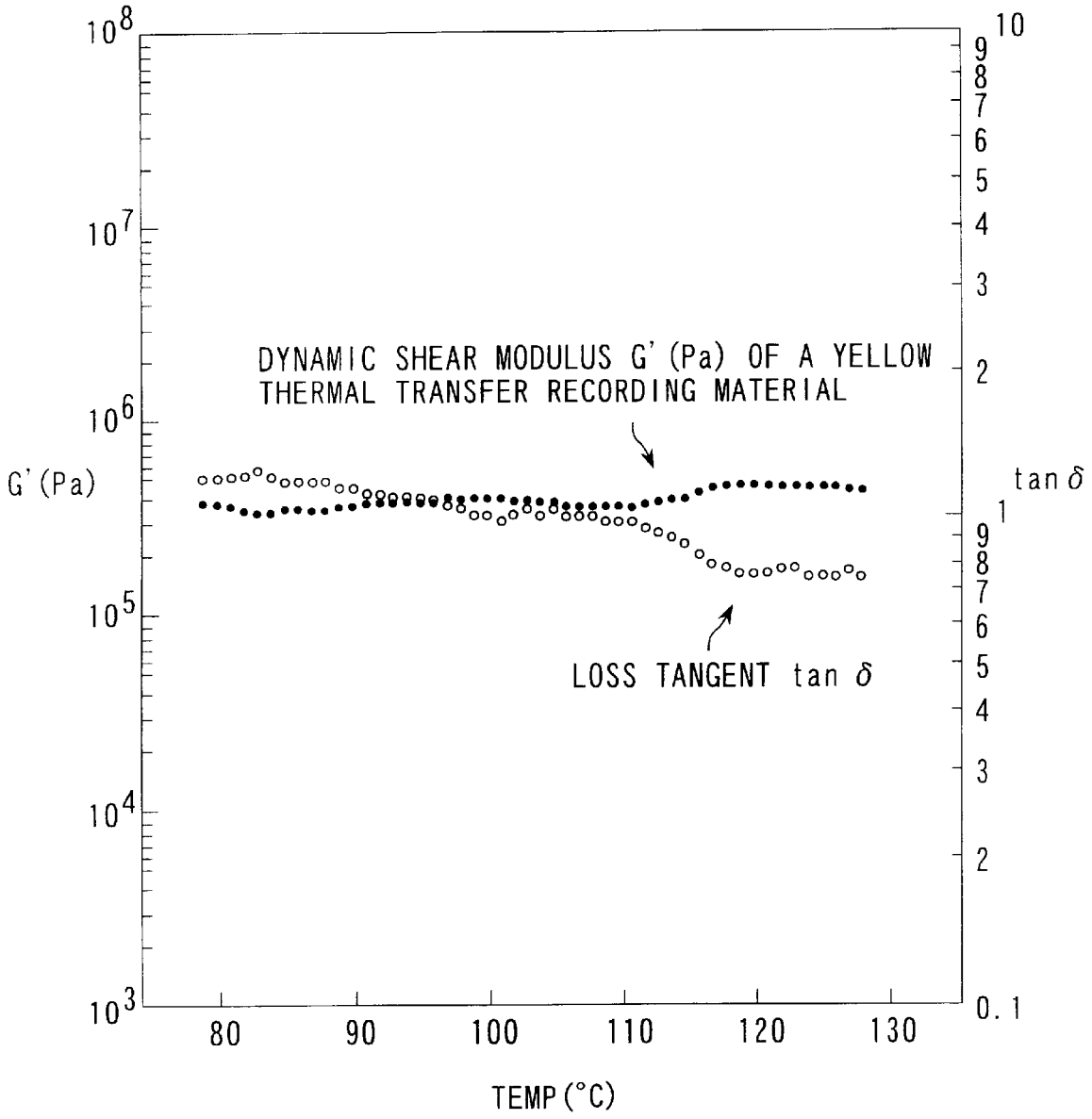
FIG. 9 is a graph representing a characteristic of dynamic shear modulus of elasticity and loss tangent tan δ of a thermal transfer recording material of a yellow thermal transfer recording medium used on a thermal transfer recording apparatus according to an embodiment of the same.

FIG. 7 represents typical dynamic shear modulus of elasticity and the loss tangent tan δ at the temperature range from the melting point to the melting point plus 50° C. of the thermal transfer recording material of the magenta thermal transfer recording medium; FIG. 8 represents the same of the cyan typical dynamic shear modulus of elasticity and the loss tangent tan δ at the temperature range from the melting point to the melting point plus 50° C. of the thermal transfer recording material of the cyan thermal transfer recording medium; FIG. 9 represents the same of the yellow typical dynamic shear modulus of elasticity and the loss tangent tan δ at the temperature range from the melting point to the melting point plus 50° C. of the thermal transfer recording material of the cyan thermal transfer recording medium. The melting point of the thermal transfer recording material of the magenta, cyan and yellow thermal transfer recording mediums is, as described hereinbefore 80° C., 79° C. and 78° C., respectively.

Further, another evaluation was carried out while increasing the conveyance speed of the printing medium 5, 50 mm/sec, 100 mm/sec, 150 mm/sec, 200 mm/sec and 250 mm/sec: and the same results as listed in Table 1 above was obtained.

Next, another evaluation was carried out as to the line pressure applied to the heat generating element 36 of a line type thermal head on the following items. Width of the used line type thermal head is 100 mm; and resolution of the heat generating element 36 is 12 dot/mm. The printing medium 5 is paper of Beck smoothness approximately 300 seconds. The thermal transfer recording medium 21 is a magenta thermal transfer recording medium, and the transfer material is the material M1 listed in Table 1 hereinbefore. Evaluation was carried out on the following items under the conditions: conveyance speed of the printing medium 5 is 125 mm/sec; and peeling distance is 0.2 mm.

(1) Transfer probability: As to image elements made of 8 dot×8 dot, number of the image elements which are 90% or more and 110% or less of the size of the normal image element is counted. And its percentage against the total number of samples 50 is calculated.

When the percentage thereof is:

More than 90% . . . AA

More than 80% and 90% or less

More than 70% and 80% or less . . . B

70% or less . . . C (2) Influence of wrinkles on the thermal transfer recording medium.

Not disturbing . . . AA

Little disturbing . . . A

A little disturbing . . . B

Remarkably disturbing . . . C

Evaluation results were listed in Table 2 below.

TABLE 2

| Line pressure [N/mm] | Transfer probability | Influence of wrinkles |
|---|---|---|
| 0.1 | C | AA |
| 0.2 | B | AA |
| 0.3 | A | AA |
| 0.5 | A | AA |
| 0.8 | A | A |
| 1.0 | A | A |
| 1.1 | A | B |
| 1.2 | A | C |

From the evaluation results described above, it was cleared that high quality recorded images were obtained when the line pressure fell within 0.3 N/mm to 1.0 N/mm.

Next, a description will be given as to evaluation result of color recording (overlap transfer). Width of the used line type thermal head is 100 mm; line pressure is 0.7 N/mm; and resolution of the heat generating element 36 is 12 dot/mm. The printing medium 5 is paper of Beck smoothness approximately 300 seconds. Evaluation was carried out on the following items under the conditions: conveyance speed of the printing medium 5 is 100 mm/sec. Distance between each thermal head 1 to 4 is 100 mm; and peeling distance is 0.2 mm. Evaluation was carried out based on the edge sharpness characteristic of the recorded image. Order of color recording (overlap transfer) of the colors is as shown in Table 3 and every combination of colors was subject to the evaluation.

TABLE 3

| | First color | Second color | Third color |
|---|---|---|---|
| Overlap 1 | M | C | — |
| Overlap 2 | M | Y | — |
| Overlap 3 | M | C | Y |
| Overlap 4 | M | Y | C |
| Overlap 5 | C | M | — |
| Overlap 6 | C | Y | — |
| Overlap 7 | C | M | Y |
| Overlap 8 | C | Y | M |
| Overlap 9 | Y | M | — |
| Overlap 10 | Y | C | — |
| Overlap 11 | Y | M | C |
| Overlap 12 | Y | C | M |

Evaluation was carried out in accordance with the transfer order listed in Table 3 above and the combination of the thermal transfer recording material 23 for each color, which has the characteristic as listed in Table 1 hereinbefore. As a result, same as the monochrome recording, the thermal transfer recording material 23 to be transferred falls within the following conditions, i.e., temperature range is from the melting point of the thermal transfer recording material 23 to the melting point plus 50° C.; measuring frequency is 0.5

Hz; dynamic shear modulus of elasticity is $1\times10^3$ Pa to $8\times10^5$ Pa and loss tangent tan δ value is 0.6 to 2.5, a high quality transferred image was obtained.

Also, when the color recording (overlap transfer) evaluation was made under the same conditions as above while changing the conveyance speed of the printing medium 5 as 50 mm/sec, 150 mm/sec, 200 mm/sec, a good edge sharpness characteristic of the transferred image was obtained. When a color recording (overlap transfer) is made at the same conveyance speed as above with a distance of 100 mm between each 1 to 4, the previously transferred thermal transfer recording material 23-3 is in a softened status.

Next, referring to the figures, a description will be made as to another embodiment of the thermal transfer recording medium 21. A part which is the identical as the part of the previously described embodiment will given the same reference numeral, and the different portions from the same only will be described.

Figure 10:
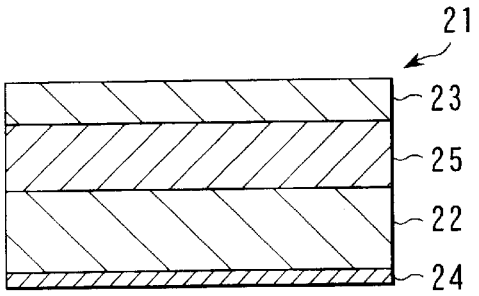
FIG. 10 is a sectional view showing another embodiment of a thermal transfer recording medium used for a thermal transfer recording apparatus according to an embodiment of the same.

FIG. 10 is a sectional view showing essential constitution of the thermal transfer recording medium 21. The thermal transfer recording medium 21 includes the supporting material 22, the intermediate layer 25 formed over the supporting material 22, the thermal transfer recording material 23 formed over the intermediate layer 25 and the back coat layer 24 formed over the backside face of the supporting material 22. Within a temperature range from the melting point of the thermal transfer recording material 23 to the melting point plus 50° C., the dynamic shear modulus of the intermediate layer 25 at a frequency of 0.5 Hz is smaller than $1\times10^3$ Pa.

The intermediate layer 25 is a layer mostly made of wax materials. One or a mix of Japan wax, beeswax, carnauba wax, microcrystaline wax, paraffin wax, rise wax, polyethylene wax, polypropylene wax, oxidized wax is used.

Figure 11:
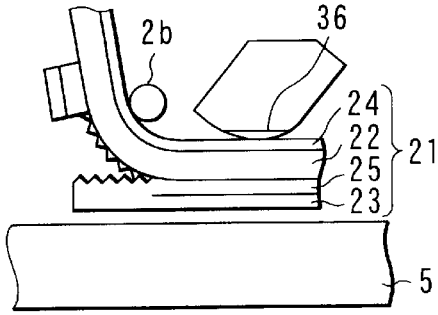
FIG. 11 is an enlarged detail illustrating peeling situation of another embodiment of a thermal transfer recording medium used for a thermal transfer recording apparatus according to an embodiment of the same.
Figure 12:
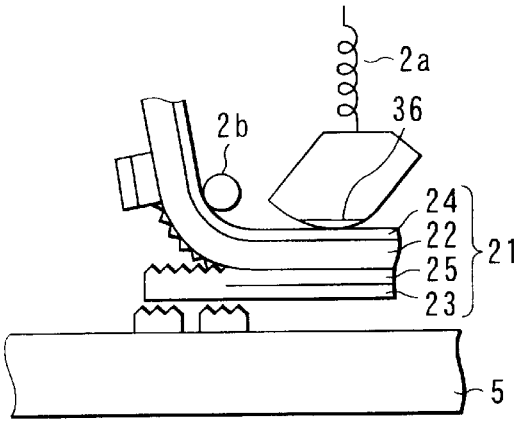
FIG. 12 is an enlarged detail illustrating peeling situation of another embodiment of a thermal transfer recording medium used for a thermal transfer recording apparatus according to an embodiment of the same.

Now, a description will be made as to peeling situation of the thermal transfer recording material 23 on the thermal transfer recording medium 21. FIG. 11 and FIG. 12 are the enlarged details illustrating a peeling situation of the thermal transfer recording material 23 on the thermal transfer recording medium 21. FIG. 11 shows a situation wherein a thermal transfer recording material 23 is transferred onto the printing medium 5; FIG. 12 shows a situation wherein the second color (cyan) is transferred after the first color (magenta) is transferred onto the printing medium 5.

The intermediate layer 25 is made of a material which has a melting point 5° C. to 40° C. lower than the melting point of the thermal transfer recording material 23 and as it is completely melted at a temperature in which the thermal transfer recording material 23 is softened or melted and has almost no adhesiveness, it enables the thermal transfer recording material 23 to be peeled off easily than the thermal transfer recording material 23. Accordingly, it is made possible to reduce the first force. Further, as the first force can be reduced, it is made possible to reduce the energy applied to each heat generating element 36 on the line type thermal head resulting in an energy saving.

Next, a description will be made as to a recording result using a thermal transfer recording medium 21 having the intermediate layer 25 described above. Width of the line type thermal head used for the evaluation is 100 mm; line pressure is 0.7 N/mm; resolution of the heat generating element 36 is 24 dot/mm. The printing medium 5 is a paper with Beck smoothness approximately 500 sec. The thermal transfer recording medium 21 is the magenta thermal transfer recording medium, and the melting point of the thermal transfer recording material of the magenta thermal transfer recording medium is 80° C. Conveyance speed of the printing medium 5 is 100 mm/sec. The peeling distance is 0.2 mm. The melting point of the intermediate layer 25 is 65° C. Items to be evaluated are, as same as described hereinbefore, the transfer probability and the edge sharpness characteristic of the transferred image.

When the following conditions are fulfilled, i.e., within a temperature range from the melting point of the thermal transfer recording material 23 to the melting point plus 50° C., the dynamic shear modulus of elasticity of a measuring frequency of 0.5 Hz is $1\times10^3$ Pa to $8\times10^5$ Pa; and the loss tangent tan δ is 0.6 to 2, printing medium 5 high quality transferred image were obtained.

Further, as shown in Table 4, when the following conditions, i.e., within a temperature range from the melting point from the melting point of the thermal transfer recording material 23 to the melting point plus 50° C., the dynamic shear modulus at a measuring frequency of 0.5 Hz is $1\times10^4$ Pa to $7\times10^5$ Pa; and the loss tangent tan δ is 0.7 to 2.2, the quality of the transferred images were particularly excellent. Also, in color recording (overlap transfer), the same tendency was found.

TABLE 4

| | Dynamic shear modulus of elasticity [Pa] | Loss tangent | Transfer probability | Sharpness |
|---|---|---|---|---|
| M material 10 | $1\times10^4$ to $9\times10^4$ | 1.7 to 2.2 | AA | AA |
| M material 11 | $2\times10^5$ to $7\times10^5$ | 0.7 to 1.5 | AA | AA |
| M material 12 | $5\times10^4$ to $3\times10^5$ | 1.5 to 2.0 | AA | AA |

Next, a description will be made as to the configuration of the line type thermal head and a contact status of the printing medium 5. In the embodiment described hereinbefore, as shown in FIG. 3A, between the main face 31-1 and the end face 31-2 on the flat base 31 made of a material such as alumina etc, slope face 31-3 are formed and a heat generating element 36 is formed on the slope thereof.

When this type line thermal head is used, as it is made possible to convey a printing medium 5 without bending the same, a high speed recording is enabled. It is made possible to reduce the distance between each line type thermal head. Further, with a line type thermal head as shown in FIG. 3A, as pressure is concentrated adjacent to the heat generating element 36 contact status is improved and a high quality recorded image can be obtained. Particularly, when a line type thermal head constituted as shown in FIG. 3A under a line pressure range of 0.4 to 0.7 N/mm, a high quality recorded image was obtained.

Figure 13:
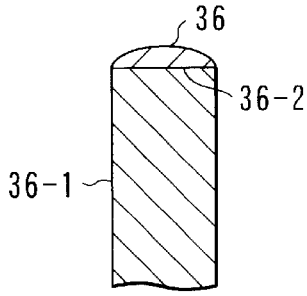
FIG. 13 is a sectional view showing an example of another construction of a line type thermal head according to an embodiment of the same.

Further, as to another embodiment of line type thermal head which allows o linear conveyance of the printing medium 5, as shown in FIG. 13, the heat generating element 36 may be mounted on the end face 36-2, and a drive IC may be packaged in the main face 36-1.

Further more, as to the printing medium 5, with a paper, plastic sheet or plastic card etc which has a surface smoother than the paper with Beck smoothness 300 to 500 sec as described hereinbefore the same advantages can be obtained.

Figure 14:
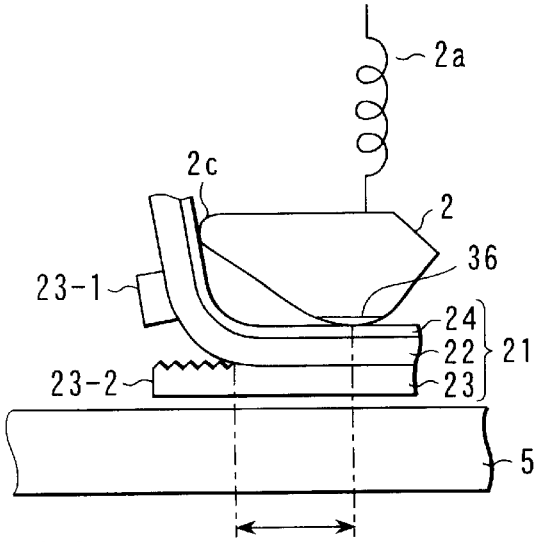
FIG. 14 is another enlarged detail illustrating peeling situation of a thermal transfer recording material for a thermal transfer recording apparatus according to an embodiment of the same.

Still further, as shown in FIG. 5, the peeling guide 2*b* is provided separately from the thermal head for M 2. However, as shown in FIG. 14 it may be adapted so that the thermal transfer recording material 23 is peeled off from the supporting material 22 by an edge portion 2C of the thermal head for M 2.

Figure 15:
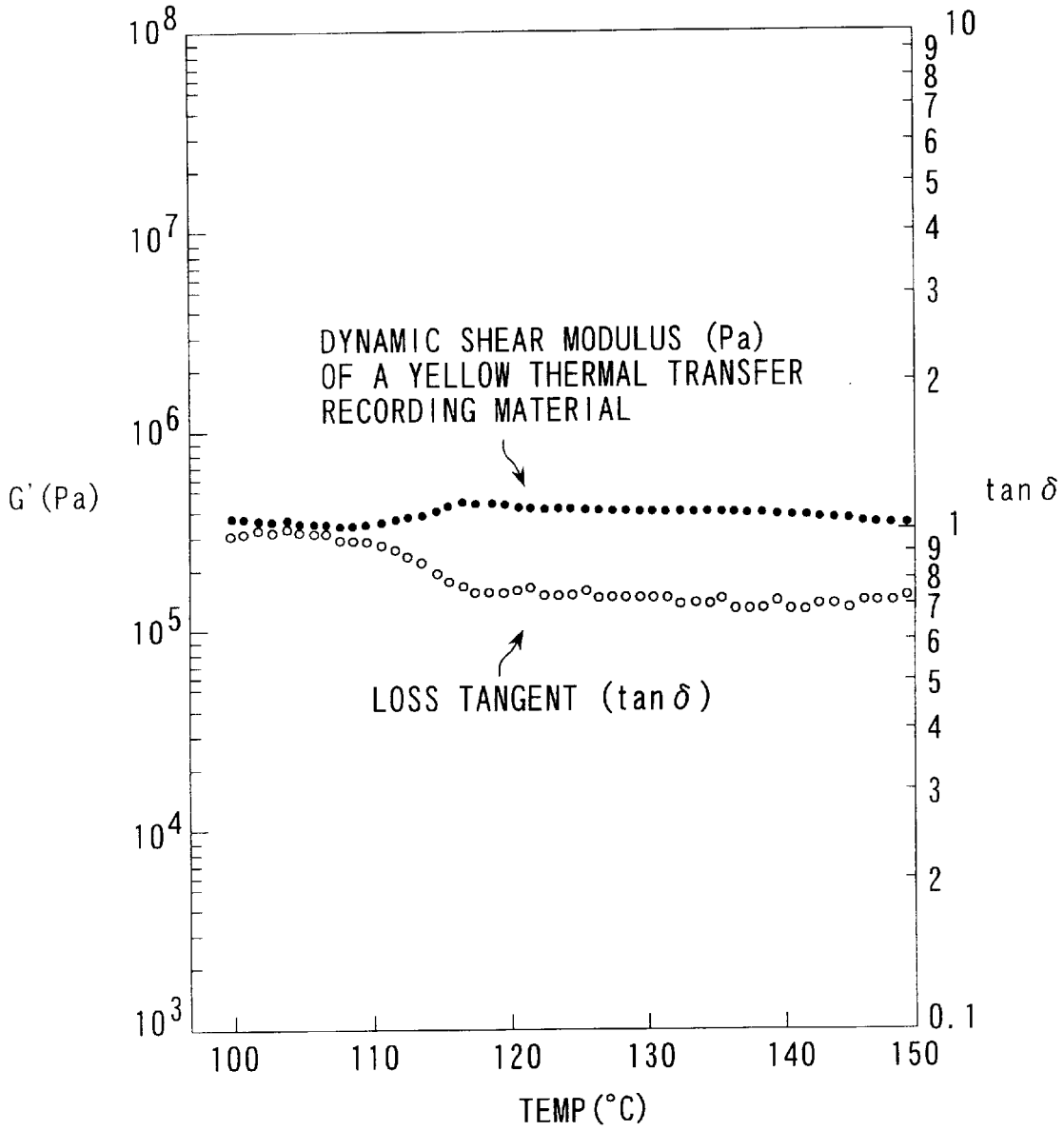
FIG. 15 is a graph representing a characteristic of dynamic shear modulus of elasticity and loss tangent tan δ of a thermal transfer recording material of a yellow thermal transfer recording medium used on a thermal transfer recording apparatus according to an embodiment of the same.
Figure 16:
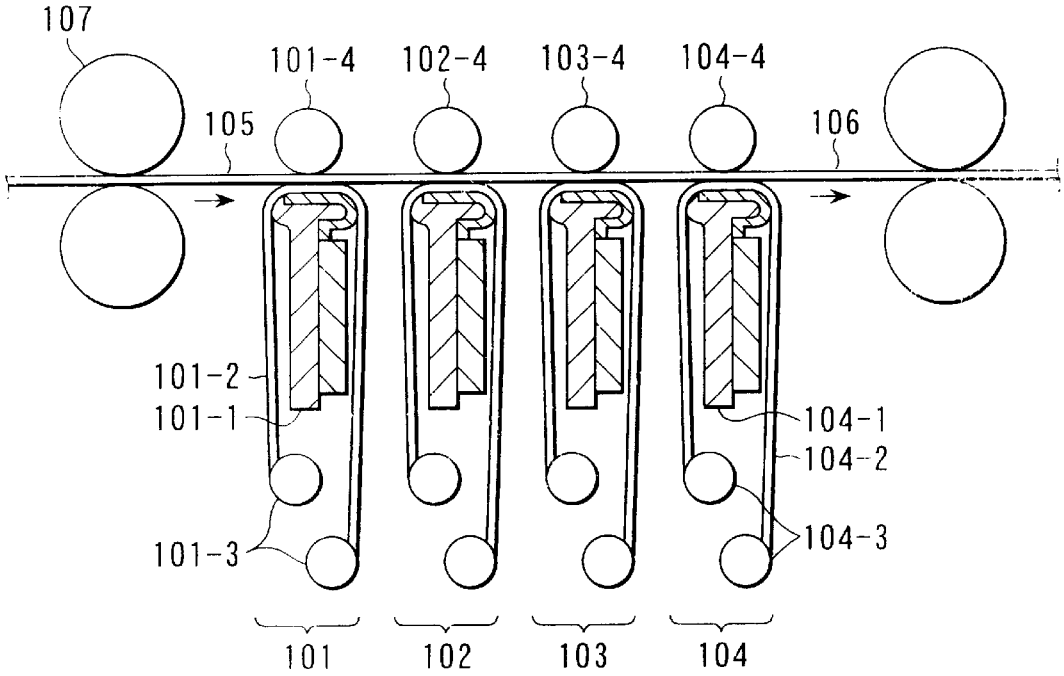
FIG. 16 is a schematic illustration showing an example of a conventional thermal transfer recording apparatus.

Still further again, in the embodiments of the present invention described hereinbefore a thermal transfer recording material, of which dynamic shear modulus is $1\times10^3$ Pa to $8\times10^5$ Pa and the loss tangent tan δ is 0.6 to 2.5 measured with dynamic viscoelasticity measurement with a frequency 0.5 Hz within a temperature range from the melting point to the melting point plus 50° C., is used. However, it was made clear that the dynamic shear modulus of elasticity of the thermal transfer recording material 23 at 100° C. to 150° C. is, as shown in FIG. 15, less than $1\times10^3$ to $8\times10^5$ Pa and the loss tangent tan δ value is 0.6 to 2.5, a high quality print, can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal transfer recording apparatus, comprising:

a line type thermal head provided with a plurality of heat generating elements disposed thereon;

a thermal transfer recording medium formed with thermal transfer recording material on a surface of a supporting material, of which dynamic shear modulus of elasticity is within a range of $1\times10^3$ Pa to $8\times10^5$ Pa, and loss tangent tan δ is within a range of 0.6 to 2.5 measured in dynamic viscoelasticity measurement in a temperature range of the melting point thereof to 50° C. over the melting point at a frequency of 0.5 Hz;

first conveyance means for conveying a printing medium;

second conveyance means for conveying each thermal transfer recording medium;

pressure contact means for pressurizing said heat generating elements against said thermal transfer recording medium to bring the same into contact therewith with a load of 0.3 to 1.0 N/mm, which is load per unit length in the direction of the arrangement of the heat generating elements; and transfer means for transferring said thermal transfer recording material to said printing medium by causing each heat generating element of the line type thermal head to generate heat at a recording time and by peeling off the thermal transfer recording material in a softened or melted status from the supporting material.

2. A thermal transfer recording apparatus according to claim 1, wherein peeling means for peeling off said thermal transfer recording medium from said printing medium is provided, said transfer means peels off said thermal transfer recording material in a softened or melted status from the supporting material and transfers the same to said printing medium by controlling the conveyance speeds of the first and second conveyance means to control the peeling time from a moment when said thermal transfer recording medium is heated by said heat generating elements to a moment when the same is peeled off from the supporting material thereof by said peeling means.

3. A thermal transfer recording apparatus according to claim 1, wherein, said thermal transfer recording medium includes an intermediate layer between the supporting material and the thermal transfer recording material, of which dynamic shear modulus of elasticity is smaller than $1\times10^3$ Pa measured by dynamic viscoelasticity measurement in a temperature range of the melting point of the thermal transfer recording material to 50° C. over the melting point at a frequency of 0.5 Hz.

4. A thermal transfer recording apparatus according to claim 3, wherein, a thermal transfer recording material is used as said thermal transfer recording material, of which dynamic shear modulus of elasticity is within a range of $1\times10^4$ Pa to $7\times10^5$ Pa, and loss tangent tan δ is within a range of 0.7 to 2.2 measured by dynamic viscoelasticity measurement in a temperature range of the melting point thereof to 50° C. over the same at a frequency of 0.5 Hz.

5. A thermal transfer recording apparatus according to claim 3, wherein, the line type thermal head is provided with the heat generating elements disposed on the slope face between a main face and an end face on the flat base or on the end face thereof.

6. A thermal transfer recording apparatus according to claim 1, wherein said line type thermal head is provided with the heat generating elements disposed on the slope face between a main face and an end face on the flat base, or on the end face thereof.

7. A thermal transfer recording apparatus comprising;

a plurality of line type thermal heads provided with a plurality of heat generating elements disposed thereon, respectively, disposed with a specific distance from each other;

thermal transfer recording media formed, respectively, with thermal transfer recording material on a surface of supporting material and provided to each thermal head respectively, of which dynamic shear modulus of elasticity is within a range of $1\times10^3$ Pa to $8\times10^5$ Pa, and loss tangent tan δ is within a range of 0.6 to 2.5 measured in dynamic viscoelasticity measurement in a temperature range of the melting point thereof to 50° C. over the melting point at a frequency of 0.5 Hz;

first conveyance means for conveying a printing medium;

second conveyance means for conveying each thermal transfer recording medium;

pressure contact means for pressurizing said heat generating elements against said thermal transfer recording media to bring the same into contact therewith respectively, with a load of 0.3 to 1.0 N/mm, which is load per unit length in the direction of the arrangement of the heat generating elements; and transfer means for transferring said thermal transfer recording materials to said printing medium while shifting the timing in order and overlapping the thermal transfer materials of different colors at the same location on said printing medium by causing each heat generating element of the line type thermal heads to generate heat at a recording time and by peeling off the same in a softened or melted status from the supporting materials thereof.

8. A thermal transfer recording apparatus according to claim 7, wherein peeling means for peeling off said thermal transfer recording medium from said printing medium is provided, said transfer means peels off said thermal transfer recording material in a softened or melted status from the supporting material thereof and transfers the same to said printing medium by controlling the conveyance speeds of the first and second conveyance means to control the peeling time from a moment when said thermal transfer recording medium is heated by said heat generating elements to a moment when the same is peeled off from the supporting material thereof by said peeling means.

9. A thermal transfer recording apparatus according to claim 7, wherein, said thermal transfer recording medium includes an intermediate layer between the supporting material and the thermal transfer recording material, of which dynamic shear modulus of elasticity is smaller than $1\times10^3$ Pa measured by dynamic viscoelasticity measurement in a temperature range of the melting point of the thermal transfer recording material to 50° C. over the melting point at a frequency of 0.5 Hz.

10. A thermal transfer recording apparatus according to claim 9, wherein, said line type thermal head is provided with the heat generating elements disposed on the slope face between the main face and the end face on the flat base or on the end face thereof.

11. A thermal transfer recording apparatus according to claim 9, wherein, a thermal transfer recording material is used as said thermal transfer recording material, of which dynamic shear modulus of elasticity is within a range of $1\times10^4$ Pa to $7\times10^5$ Pa, and loss tangent tan δ is within a range of 0.7 to 2.2 measured by dynamic viscoelasticity measurement in a temperature range of the melting point thereof to 50° C. over the same at a frequency of 0.5 Hz.

12. A thermal transfer recording apparatus according to claim 7, wherein, said line type thermal head is provided with the heat generating elements disposed on the slope face between a main face and an end face on the flat base or on the end face thereof.

13. A thermal transfer recording apparatus according to claim 7, wherein, while said thermal transfer recording material previously transferred to said printing medium is still in a softened status, the next thermal transfer recording material is transferred in an overlapping manner.

14. A thermal transfer recording apparatus according to claim 13, wherein, the line type thermal head is provided with the heat generating elements disposed on the slope face between a main face and an end face on the flat base or on the end face thereof.

15. A method for thermal transfer recording which transfers a thermal transfer recording material from a thermal transfer recording medium to a printing medium to make a printing by heat generation of each heat generating element of a line type thermal head provided with a plurality of heat generating elements disposed thereon, comprising the steps of utilizing thermal transfer recording material of which dynamic shear modulus of elasticity is within a range of $1\times10^3$ Pa to $8\times10^5$ Pa, and loss tangent tan δ is within a range of 0.6 to 2.5 measured in dynamic viscoelasticity measurement in a temperature range of the melting point thereof to 50° C. over the melting point at a frequency of 0.5 Hz; pressurizing heat generating elements on said line type thermal head against said thermal transfer recording medium to bring the same into contact therewith with a load of 0.3 to 1.0 N/mm, which is load per unit length in the direction of the arrangement of the heat generating elements as well as transferring said thermal transfer recording material to said printing medium by peeling off the same in a softened or melted status from the supporting material thereof.

16. A method for thermal transfer recording according to claim 15, wherein peeling means for peeling off said thermal transfer recording medium from said printing medium is provided, said transfer means peels off said thermal transfer recording material in a softened or melted status from the supporting material thereof and transfers the same to said printing medium by controlling the conveyance speeds of the first and second conveyance means to control the peeling time from a moment when said thermal transfer recording medium is heated by said heat generating elements to a moment when the same is peeled off from the supporting material thereof by said peeling means.

17. A method for thermal transfer recording according to claim 15, wherein, said thermal transfer recording medium includes an intermediate layer between the supporting material and the thermal transfer recording material, of which dynamic shear modulus of elasticity is smaller than $1\times10^3$ Pa measured by dynamic viscoelasticity measurement in a temperature range of the melting point of the thermal transfer recording material to 50° C. over the same at a frequency of 0.5 Hz.

18. A method for thermal transfer recording according to claim 17, wherein, a thermal transfer recording material is used as said thermal transfer recording material, of which dynamic shear modulus of elasticity is within a range of $1\times10^4$ Pa to $7\times10^5$ Pa, and loss tangent tan δ is within a range of 0.7 to 2.2 measured by dynamic viscoelasticity measurement in a temperature range of the melting point thereof to 50° C. over the melting point at a frequency of 0.5 Hz.

19. A method for thermal transfer recording according to claim 17, wherein, the line type thermal head is provided with the heat generating elements disposed on the slope face between a main face and an end face on the flat base or on the end face thereof.

20. A method for thermal transfer recording according to claim 15, wherein said line type thermal head is provided with the heat generating elements disposed on the slope face between the main face and the end face on the flat base, or on the end face thereof.

21. A method for thermal transfer recording which transfers thermal transfer recording materials to said printing medium while shifting the timing in order and overlapping the thermal transfer materials of different colors at the same location on said printing medium by heating each heat generating element of the line type thermal heads disposed with a specific distance from each other comprising the steps of: utilizing a thermal transfer recording material of which dynamic shear modulus of elasticity is within a range of $1\times10^3$ Pa to $8\times10^5$ Pa, and loss tangent tan δ is within a range of 0.6 to 2.5 measured in dynamic viscoelasticity measurement in a temperature range of the melting point thereof to 50° C. over the melting point at a frequency of 0.5 Hz; pressurizing heat generating elements on said line type thermal head against said thermal transfer recording medium to bring the same into contact therewith with a load of 0.3 to 1.0 N/mm, which is load per unit length in the direction of the arrangement of the heat generating elements as well as transferring said thermal transfer recording material to said printing medium by peeling off the same in a softened or melted status from the supporting material thereof.

22. A method for thermal transfer recording according to claim 21, wherein peeling means for peeling off said thermal transfer recording medium from said printing medium is provided, said transfer means peels off said thermal transfer recording medium in a softened or melted status from the supporting material thereof and transfers the same to said printing medium by controlling the first and second conveyance speed to control the peeling time from a moment when said thermal transfer recording medium is heated by said heat generating elements to a moment when the same is peeled off from the supporting material thereof by said peeling means.

23. A method for thermal transfer recording according to claim 21, wherein, said thermal transfer recording medium includes an intermediate layer between the supporting material and the thermal transfer recording material, of which dynamic shear modulus of elasticity is smaller than $1\times10^3$ Pa measured by dynamic viscoelasticity measurement in a temperature range of the melting point of the thermal transfer recording material to 50° C. over the same at a frequency of 0.5 Hz.

24. A method for thermal transfer recording according to claim 23, wherein, the line type thermal head is provided with the heat generating elements disposed on the slope face between the main face and the end face on the flat base or on the end face thereof.

25. A method for thermal transfer recording according to claim 23, wherein, a thermal transfer recording material is used as said thermal transfer recording material, of which dynamic shear modulus of elasticity is within a range of $1\times10^4$ Pa to $7\times10^5$ Pa, and loss tangent tan δ is within a range of 0.7 to 2.2 measured by dynamic viscoelasticity measurement in a temperature range of the melting point thereof to 50° C. over the melting point at a frequency of 0.5 Hz.

26. A method for thermal transfer recording according to claim 21, wherein, the line type thermal head is provided with the heat generating elements disposed on the slope face between the main face and the end face on the flat base or on the end face thereof.

27. A method for thermal transfer recording according to claim 21, wherein, during said thermal transfer recording material previously transferred to said printing medium is still in a softened status, the next thermal transfer recording material is transferred overlapping the same.

28. A method for thermal transfer recording according to claim 27, wherein, the line type thermal head is provided with the heat generating elements disposed on the slope face between the main face and the end face on the flat base or on the end face thereof.

* * * * *